US011551503B1

(12) United States Patent
Alniami

(10) Patent No.: US 11,551,503 B1
(45) Date of Patent: Jan. 10, 2023

(54) SANITIZING SYSTEM

(71) Applicant: Laith Ismail Alniami, Palmdale, CA (US)

(72) Inventor: Laith Ismail Alniami, Palmdale, CA (US)

( * ) Notice: Subject to any disclaimer, the term of this patent is extended or adjusted under 35 U.S.C. 154(b) by 0 days.

(21) Appl. No.: 17/706,415

(22) Filed: Mar. 28, 2022

(51) Int. Cl.
*G07F 1/00* (2006.01)
*G07F 7/04* (2006.01)
*G07F 1/02* (2006.01)

(52) U.S. Cl.
CPC . *G07F 7/04* (2013.01); *G07F 1/02* (2013.01)

(58) Field of Classification Search
CPC ..... G07F 7/04; G07F 1/02
USPC ..... 235/379, 381
See application file for complete search history.

(56) References Cited

U.S. PATENT DOCUMENTS 5,374,814 A * 12/1994 Kako ..... G07D 11/16 902/12
2012/0228812 A1* 9/2012 Oosawa ..... E05F 1/1091 267/124
2017/0124813 A1* 5/2017 Misener ..... G07D 3/00
2018/0005206 A1* 1/2018 Belin ..... G07F 19/203
2021/0330832 A1* 10/2021 Dobbins ..... A61L 2/10
2021/0366244 A1* 11/2021 Denny ..... G07F 19/201
2021/0402030 A1* 12/2021 Mattos Vega ..... G07F 9/10
2022/0016291 A1* 1/2022 Poole ..... A61L 2/26
2022/0044220 A1* 2/2022 Herrington ..... G06Q 20/208
2022/0062470 A1* 3/2022 Owen ..... G07D 11/00
2022/0062472 A1* 3/2022 Owen ..... A61L 2/10
2022/0072174 A1* 3/2022 Pragano ..... A61L 2/18
2022/0198885 A1* 6/2022 Denny ..... G07F 19/205

FOREIGN PATENT DOCUMENTS

CN 101359417 A * 2/2009
CN 213826093 U * 7/2021

OTHER PUBLICATIONS

CN213826093U, Novel Electric Stream Cleaning Machine, 4 pages (Year: 2022).*
CN101359417A, Automated Teller Machine for Ironing and Disinfecting When Saving and Selecting Bills of Different Denominations When Drawing Money, 7 pages (Year: 2022).*

* cited by examiner

*Primary Examiner* — Tuyen K Vo
(74) *Attorney, Agent, or Firm* — Plager Schack LLP; Mark H. Plager; Michael J. O'Brein

(57) ABSTRACT

A sanitizing system, configured to receive, sanitize and dispense payment objects; the sanitizing system has a housing with a universal money recognizer. A coin counter display and a bill counter display are arranged on the housing. A bill check in slot, a coin in slot, a bill check out slot, and a coin check out slot are arranged on the housing. When a user inserts coins into the coin in slot, the coins are counted, sanitized and released through the coin check out slot.

5 Claims, 3 Drawing Sheets

SANITIZING SYSTEM

BACKGROUND

The embodiments herein relate generally to antimicrobial equipment.

Prior to embodiments of the disclosed invention microbes were transmitted through contact with currency. Embodiments of the disclosed invention solve this problem.

SUMMARY

A sanitizing system, configured to receive, sanitize and dispense payment objects; the sanitizing system has a housing with a universal money recognizer. A coin counter display and a bill counter display are arranged on the housing. A bill check in slot, a coin in slot, a bill check out slot, and a coin check out slot are arranged on the housing. When a user inserts coins into the coin in slot, the coins are counted, sanitized and released through the coin check out slot.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
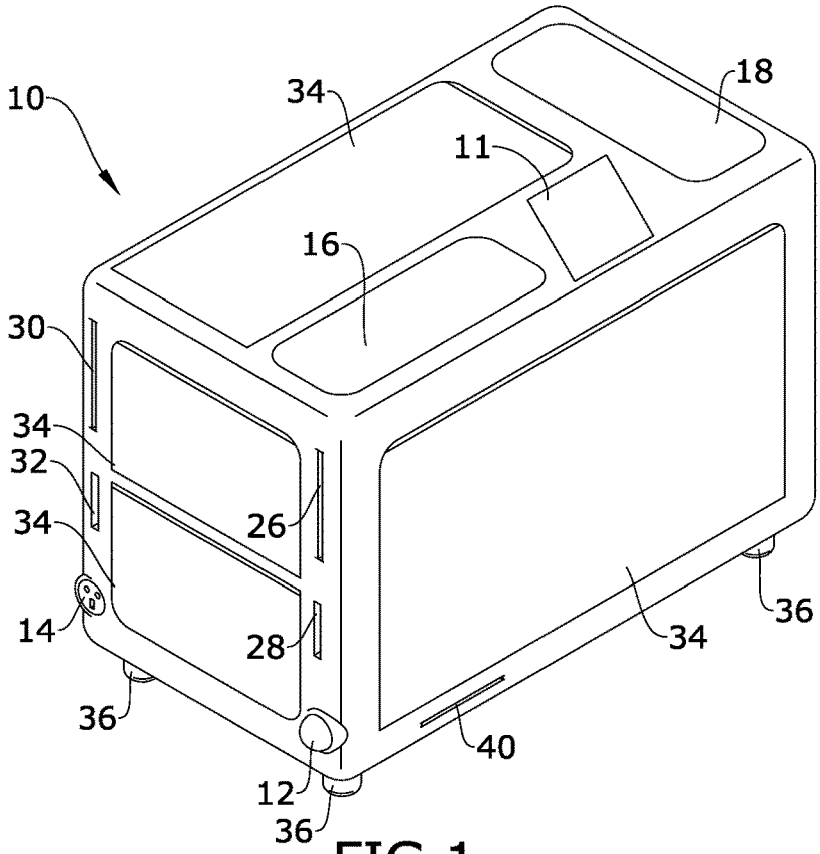
FIG. 1 shows a front prospective view of one embodiment of the present invention.
Figure 2:
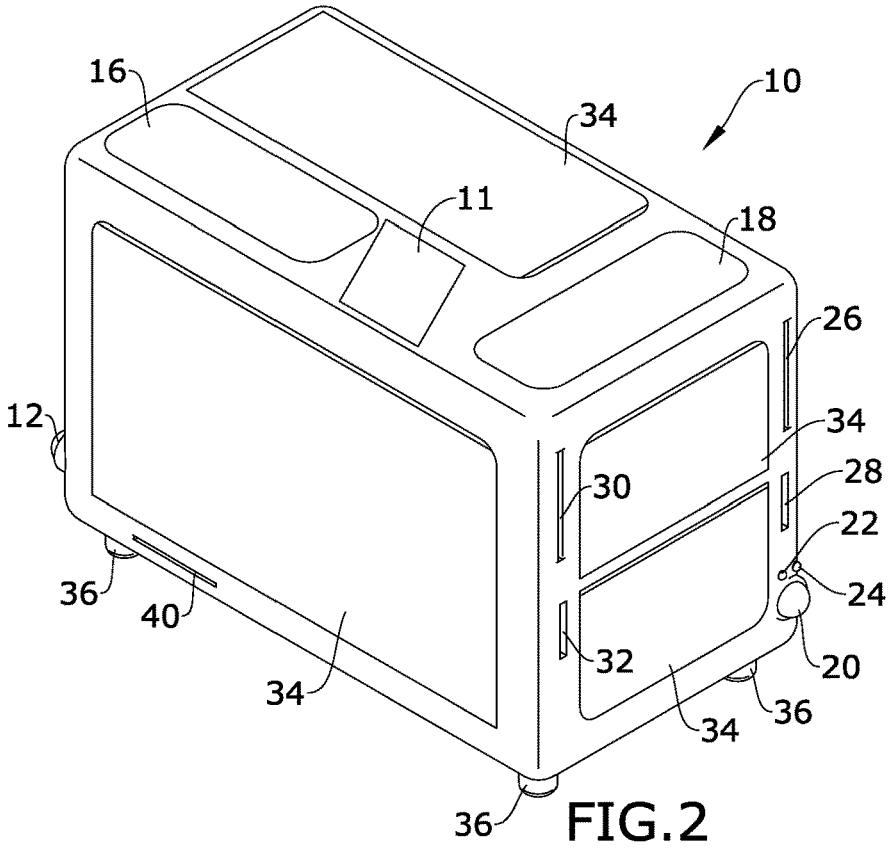
FIG. 2 shows a side prospective view of one embodiment of the present invention.
Figure 3:
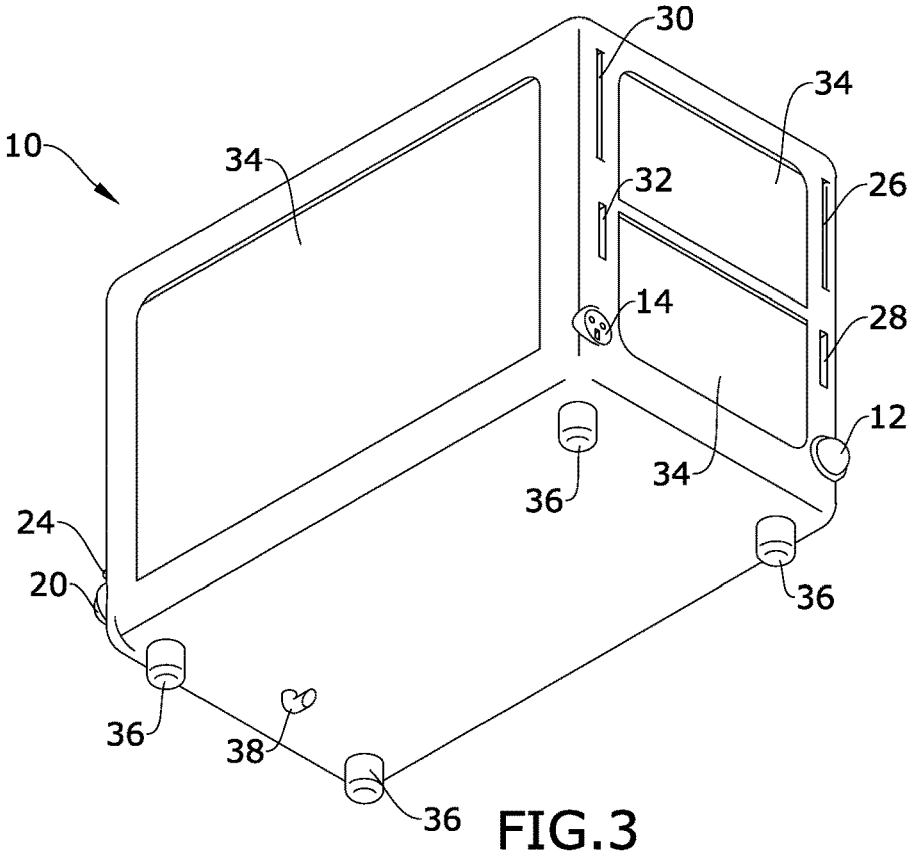
FIG. 3 shows a bottom prospective view of one embodiment of the present invention.
Figure 4:
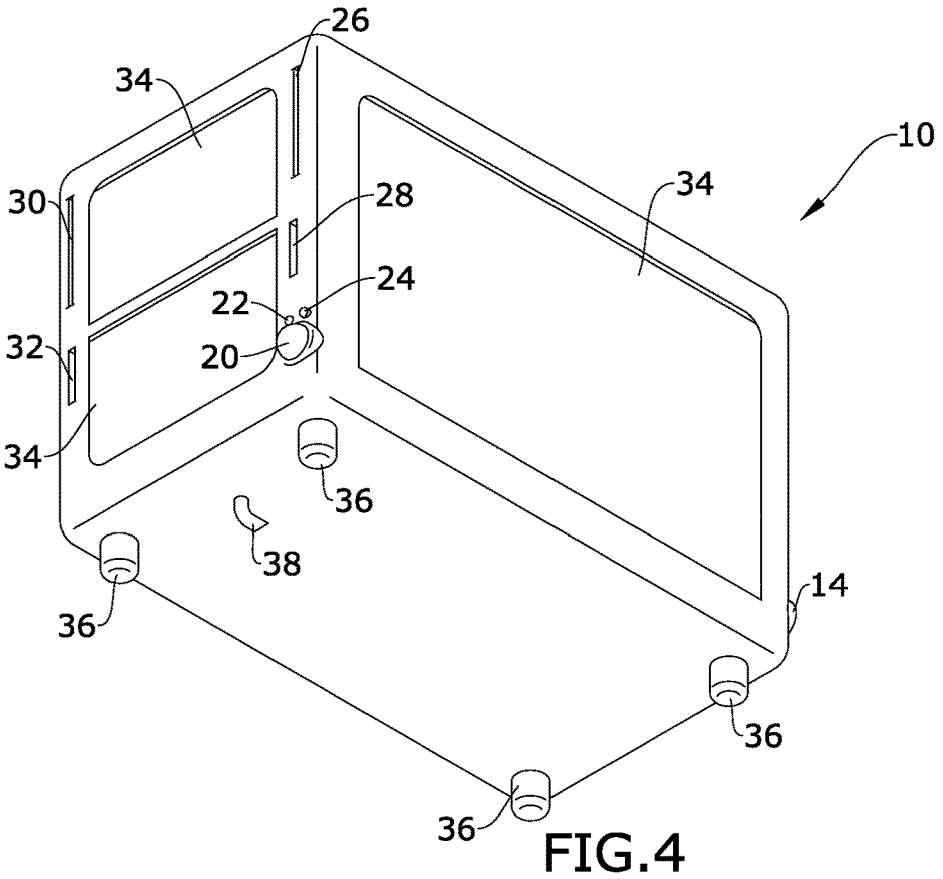
FIG. 4 shows a side prospective view of one embodiment of the present invention.

By way of example, and referring to FIG. 1, one embodiment of a money sanitizing machine 10 further comprises a housing with a universal money recognizer 11. A power button 12, attached to the housing and electrically coupled to a power adapter 14.

On top of the housing there is a coin counter display 16 and a bill counter display 18. The coin counter display 16 and the bill counter display 18 can be a digital display electrically coupled to a microcontroller which is further electrically coupled to the power button 12 and the power adapter 14.

On a first side of the housing there is a wet dry button 20, a red wet indicator light 22, a green dry indicator light 24, a bill check in slot 26, a coin in slot 28, the bill check out slot 30, and the coin check out slot 32. Arranged in several places on the housing are maintenance hatches 34. The maintenance hatches 34 allows a user to open the housing to perform maintenance and repairs on the sanitizing machine 10.

On a bottom side of the housing are stabilizer stands 36. In some embodiments, the stabilizer stands 36 can be made from rubber. A drain 38, can also be located on the bottom side of the housing. On a side of the housing is a credit card insert 40 which can be used to sanitize a credit card.

Figure 5:
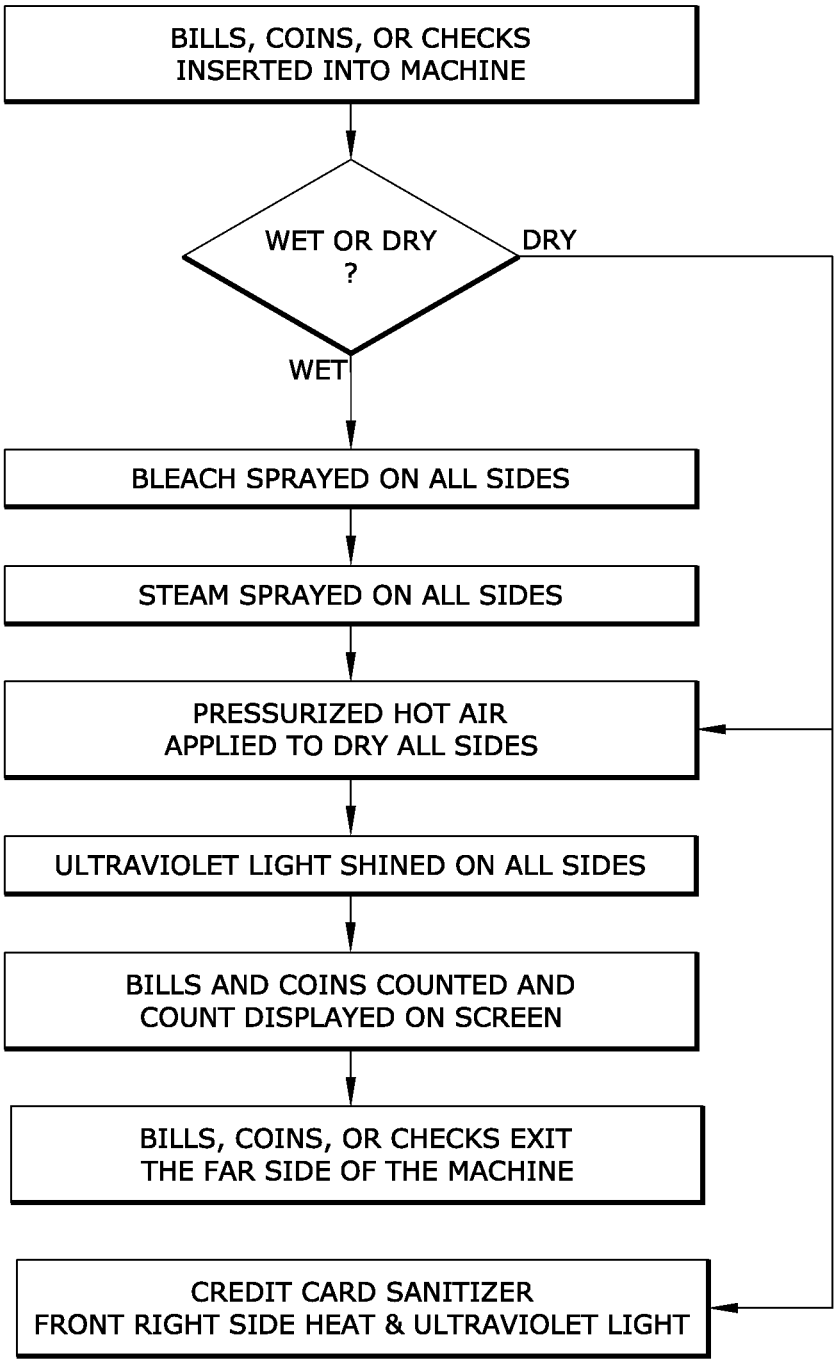
FIG. 5 shows a flow chart of one embodiment of the present invention.

FIG. 5 shows a flow chart that shows a process for using the money sanitizing machine 10. A user can insert bills, coins, checks, or credit cards into the money sanitizing machine 10. Then the money sanitizing machine 10 discerns whether the inserted material is wet or dry.

If wet, bleach is sprayed on all sides of the inserted material. Following that, steam is sprayed on all sides of the inserted material. After that, pressurized hot air is applied to dry all sides. Following that bills and coins are counted and displayed on the screen. Finally, the inserted material exits the sanitizing machine 10.

As used in this application, the term "a" or "an" means "at least one" or "one or more."

As used in this application, the term "about" or "approximately" refers to a range of values within plus or minus 10% of the specified number.

As used in this application, the term "substantially" means that the actual value is within about 10% of the actual desired value, particularly within about 5% of the actual desired value and especially within about 1% of the actual desired value of any variable, element or limit set forth herein.

All references throughout this application, for example patent documents including issued or granted patents or equivalents, patent application publications, and non-patent literature documents or other source material, are hereby incorporated by reference herein in their entireties, as though individually incorporated by reference, to the extent each reference is at least partially not inconsistent with the disclosure in the present application (for example, a reference that is partially inconsistent is incorporated by reference except for the partially inconsistent portion of the reference).

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

Any element in a claim that does not explicitly state "means for" performing a specified function, or "step for" performing a specified function, is not to be interpreted as a "means" or "step" clause as specified in 35 U.S.C. § 112, ¶6. In particular, any use of "step of" in the claims is not intended to invoke the provision of 35 U.S.C. § 112, ¶6.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A sanitizing system, configured to receive, sanitize and dispense payment objects; the sanitizing system comprising:

a housing with a universal money recognizer;

a coin counter display and a bill counter display, arranged on the housing;

a bill check in slot, a coin in slot, a bill check out slot, and a coin check out slot, arranged on the housing;

a microcontroller, electrically coupled to the coin counter display and the bill counter display are a digital display;

wherein the microcontroller is programmed with instructions to:

count coins inserted into the coin in slot;

engage a bleach sprayer to spray bleach on all sides of the coins;

engage a steam sprayer to spray steam on all sides of the coins;

engage an air sprayer to spray pressurized hot air on all sides of the coins; and release the coins through the coin check out slot.

2. The sanitizing system, of claim 1, further comprising a power button is attached to the housing and electrically coupled to a power adapter.

3. The sanitizing system of claim 2, wherein the coin counter display and the bill counter display are a digital display electrically coupled to a microcontroller.

4. The sanitizing system of claim 3, further comprising a first side of the housing there is a wet dry button electrically coupled to a red wet indicator light, a green dry indicator light, and the microcontroller.

5. The sanitizing system of claim 4, further comprising a plurality of maintenance hatches, arranged on the housing and configured to allow a user to open the housing to perform maintenance and repairs on the sanitizing system.

* * * * *